US011699872B2

(12) United States Patent
Clingman

(10) Patent No.: US 11,699,872 B2
(45) Date of Patent: Jul. 11, 2023

(54) POWER CONNECTOR WITH SPRING-BIASED ELASTOMERIC CONDUCTOR SEAL FOR SUBMERSIBLE PUMP

(71) Applicant: Baker Hughes Oilfield Operations LLC, Houston, TX (US)

(72) Inventor: James Christopher Clingman, Broken Arrow, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 37 days.

(21) Appl. No.: 17/231,552

(22) Filed: Apr. 15, 2021

(65) Prior Publication Data

US 2021/0328379 A1 Oct. 21, 2021

Related U.S. Application Data

(60) Provisional application No. 63/011,617, filed on Apr. 17, 2020.

(51) Int. Cl.

| | |
|---|---|
| ***H01R 13/52*** | (2006.01) |
| ***H01R 13/523*** | (2006.01) |
| ***E21B 17/02*** | (2006.01) |

(52) U.S. Cl.

CPC ..... *H01R 13/523* (2013.01); *E21B 17/028* (2013.01); *H01R 13/5202* (2013.01); *H01R 13/5205* (2013.01)

(58) Field of Classification Search

CPC ..... H01R 13/523; H01R 13/5202; H01R 13/5205; E21B 17/028

USPC ..... 439/271

See application file for complete search history.

(56) References Cited

U.S. PATENT DOCUMENTS

| | | | | |
|---|---|---|---|---|
| 4,728,296 | A * | 3/1988 | Stamm | H01R 13/533 439/465 |
| 5,051,103 | A | 9/1991 | Neuroth | |
| 5,700,161 | A | 12/1997 | Plummer et al. | |
| 6,361,342 | B1 | 3/2002 | Cox | |
| 6,443,780 | B2 | 9/2002 | Wilbourn et al. | |

(Continued)

FOREIGN PATENT DOCUMENTS

| | | | |
|---|---|---|---|
| CA | 2663988 | C | 10/2009 |

OTHER PUBLICATIONS

International Search Report and Written Opinion of PCT Application No. PCT/US2021/027958 (61CBL-507725) dated Jul. 20, 2021: pp. 1-9.

*Primary Examiner* — Abdullah A Riyami
*Assistant Examiner* — Vladimir Imas
(74) *Attorney, Agent, or Firm* — Bracewell LLP; Keith R. Derrington

(57) ABSTRACT

An electrical power connector for an electrical submersible well pump motor has a housing having a bore. A pair of rigid insulators are within the bore of the housing, each of the insulators having a cylindrical outward-facing side that is in contact with an inward-facing side wall of the housing. A resilient elastomer seal is sandwiched between the insulators in sealing engagement with the inward-facing side wall. Passages extend through each of the insulators and the elastomer seal for receiving insulated conductors of a power cable. A spring in abutment with one of the insulators exerts an axial compressive force on the elastomer seal.

20 Claims, 2 Drawing Sheets

(56) References Cited

U.S. PATENT DOCUMENTS

| | | | | |
|---|---|---|---|---|
| 6,676,447 | B1 * | 1/2004 | Knox | H01R 13/523 439/587 |
| 7,455,541 | B2 * | 11/2008 | Jackson | H01R 13/5205 439/589 |
| 7,575,458 | B2 | 8/2009 | Parmeter et al. | |
| 7,789,689 | B2 * | 9/2010 | Frey | H01R 13/523 439/275 |
| 7,942,696 | B2 * | 5/2011 | Watson | H01R 13/5208 439/589 |
| 8,070,426 | B2 | 12/2011 | Brunner et al. | |
| 8,491,282 | B2 * | 7/2013 | Shaver | F04B 47/06 439/271 |
| 8,512,074 | B2 * | 8/2013 | Frey | H01R 13/523 439/589 |
| 8,664,817 | B2 * | 3/2014 | Rumbaugh | H02K 3/30 310/87 |
| 8,692,115 | B2 * | 4/2014 | Rumbaugh | F04D 29/026 174/105 R |
| 8,704,416 | B2 * | 4/2014 | Rumbaugh | F04D 13/08 439/271 |
| 8,772,997 | B2 * | 7/2014 | Rumbaugh | F04D 13/08 310/215 |
| 9,709,043 | B2 * | 7/2017 | Gilmore | F04B 17/03 |
| 9,935,518 | B2 * | 4/2018 | Wilcox | E21B 17/028 |
| 10,050,375 | B1 * | 8/2018 | Semple | H01R 13/5205 |
| 10,097,060 | B2 * | 10/2018 | Rumbaugh | H02K 5/225 |
| 10,224,669 | B1 * | 3/2019 | Tanner | H01R 13/5208 |
| 2012/0052721 | A1 | 3/2012 | Watson | |
| 2017/0211363 | A1 | 7/2017 | Bradley et al. | |
| 2018/0163728 | A1 | 6/2018 | Zugelder et al. | |
| 2019/0368511 | A1 * | 12/2019 | Williams | F04D 7/04 |

* cited by examiner

POWER CONNECTOR WITH SPRING-BIASED ELASTOMERIC CONDUCTOR SEAL FOR SUBMERSIBLE PUMP

CROSS-REFERENCE TO RELATED APPLICATION

This application claims priority to provisional application Ser. No. 63/011,617, filed Apr. 17, 2020.

FIELD OF THE DISCLOSURE

This disclosure relates in general to power cable connectors for electrical submersible well pumps, and in particular to a connector with a bulk elastomeric seal between two rigid insulators, and a spring that biases the elastomeric seal.

BACKGROUND

Electrical submersible well pumps (ESP) are often used to pump liquids from hydrocarbon producing wells. A typical ESP includes a pump driven by an electrical motor. Production tubing, which comprises pipes having threaded ends secured together, supports the ESP in most installations. The pump normally pumps well fluid into the production tubing. A power cable extends alongside the production tubing to the motor for supplying power.

In one type of ESP, the power cable has on a lower end a splice that connects it to a motor lead or motor lead extension. The motor lead extends alongside the ESP and has a motor power connector on its lower end that plugs into a receptacle in the motor. A variety of motor power connectors are known. In most types, each of the three power conductors extends into a housing and has an electrical terminal for connecting to a motor wire. The housing may be in two parts, an upper housing and a lower housing. Various insulator arrangements electrically insulate the electrical terminals of the conductors.

One insulator arrangement has in the lower housing two rigid insulators with a bulk elastomeric seal sandwiched between. The insulators and the elastomeric seal have passages extending through them, each passage receiving one of the three insulated electrical conductors. When the housings are secured to each other, the insulators will exert a squeezing force on the elastomeric seal, causing it to seal around the insulated electrical conductors.

While this type works well, when exposed to high temperatures, the elastomeric seal can lose some of its compressive force and fail to seal. High temperature can occur during manufacturing when the elastomeric seal in the assembled housing is being cured. Also, high temperatures can occur in some wells. A failure to seal can result in failure of a factory acceptance test or failure of an installed ESP.

SUMMARY

An electrical power connector for an electrical submersible well pump motor, comprises a housing having a bore with a longitudinal axis and an inward-facing side wall. The bore has an upper opening for receiving a power cable. A pair of rigid insulators are within the bore of the housing. Each of the insulators has a cylindrical outward-facing side that is in contact with the inward-facing side wall. A resilient elastomer seal is sandwiched between the insulators in sealing engagement with the inward-facing side wall. A plurality of passages extend through each of the insulators and the elastomer seal for receiving insulated conductors of the power cable. A spring in abutment with one of the insulators exerts an axial compressive force on the elastomer seal.

In the embodiment shown, the spring is coaxial with the axis. The spring may comprise a wave spring. A stop member protrudes inward from the inward-facing side wall. An annular shoulder formed on one of the insulators faces the stop member. The spring is compressed between the annular shoulder and the stop member.

The spring may be an annular band having undulations and two ends that overlap each other. The spring exerts a reactive force along a load path through the elastomer seal and into the housing.

DETAILED DESCRIPTION OF THE DISCLOSURE

Figure 1:
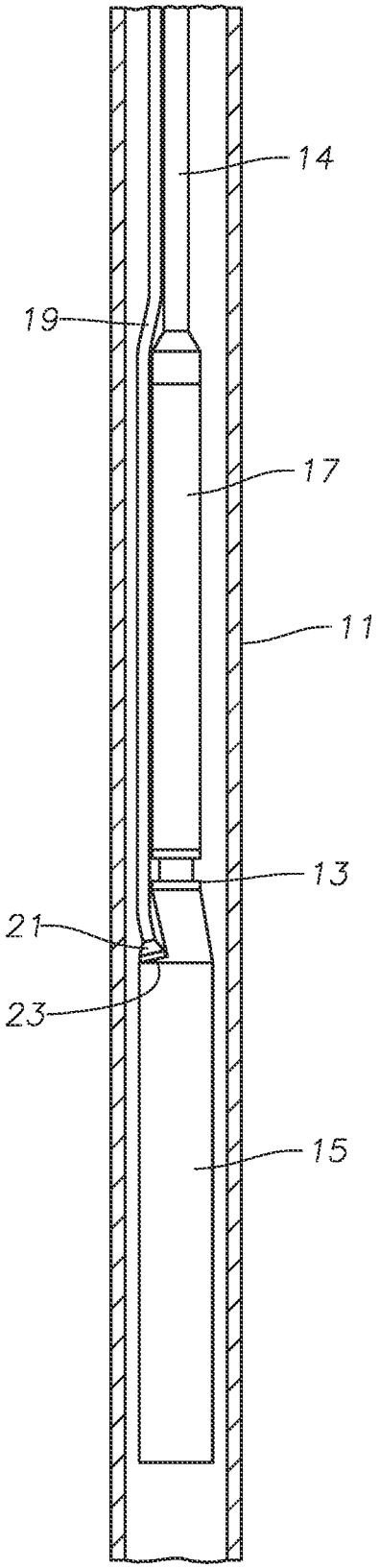
FIG. 1 is a schematic side view of an electrical submersible pump assembly suspended in a well and having a motor power connector in accordance with this invention.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper", "lower" and the like are used only for convenience as the ESP may be operated in positions other than vertical.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a cased well 11 has downhole equipment comprising an electrical submersible pumping assembly (ESP) 13, which is disposed on a string of production tubing 14. ESP 13 includes an electric motor 15 and a pump 17. Motor 15 is normally a three-phase AC type filled with a dielectric lubricant. A pressure equalizer (not shown) reduces a pressure differential between the dielectric lubricant and well fluid on the exterior of motor 17. Pump 17 may comprise a centrifugal pump or another type, such as a progressing cavity pump or a positive displacement pump.

A power cable 19, extends downhole alongside tubing 14 from a wellhead for supplying power to motor 15. Power cable 19 includes a motor lead extension that extends along pump 17. The motor lead extension of power cable 19 has a motor power connector or pothead 21 on its lower end that electrically connects and secures to a receptacle 23 near the upper end of motor 15.

Figure 2:
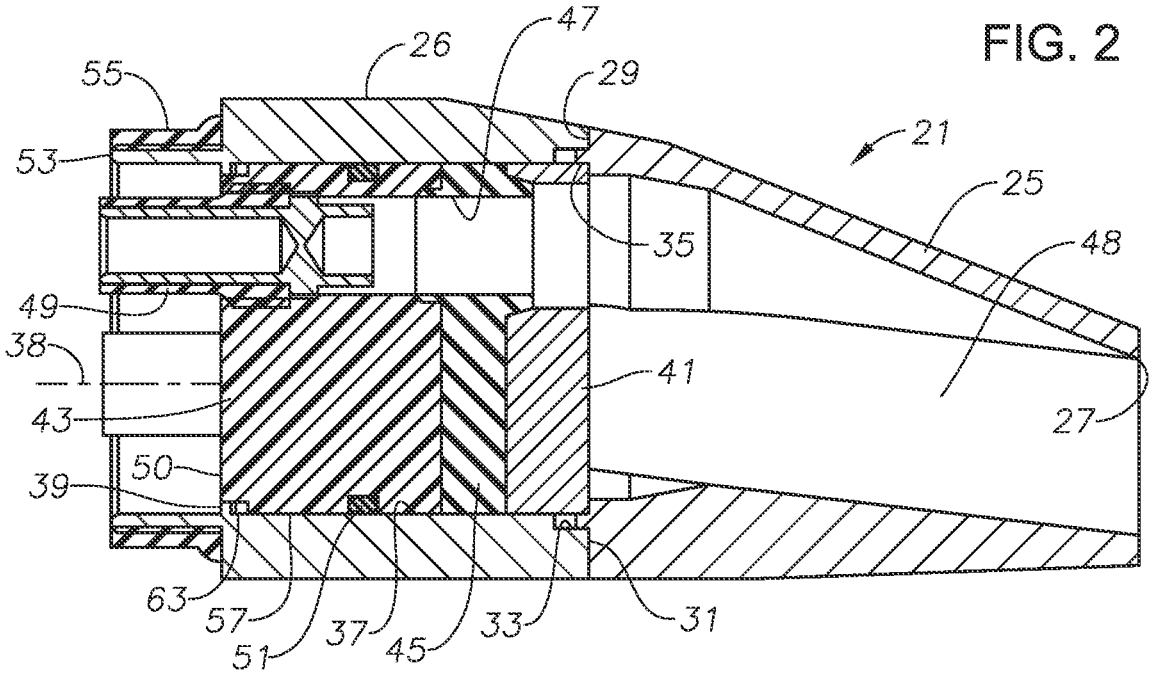
FIG. 2 is a sectional view of the motor power connector of FIG. 1, with the insulated conductors shown removed.

Referring to FIG. 2, power connector 21 has an upper housing 25 and a lower housing 26. Upper housing 25 has an upper end 27 with an opening for insertion of the lower end of power cable 19. Upper housing 25 has a lower end 29 that abuts an upper end 31 of lower housing 26. Bolts, which are not shown in the sectional drawing of FIG. 2, fasten upper housing 25 to lower housing 26. Upper end 31 of lower housing 26 has an opening 33 for receiving an annular alignment rib 35 on upper housing lower end 29.

Lower housing 26 has an interior with a cylindrical inward-facing side wall 37 extending downward from upper opening 33. A stop member 39, which may comprise an annular rib, extends radially inward from cylindrical wall 37, relative to a longitudinal axis 38 of lower housing 26.

An upper insulator 41 and a lower insulator 43 are located in the interior of lower housing 26. Each insulator 41, 43 is a cylindrical disc with an outer cylindrical surface in engagement with lower housing cylindrical wall 37. Upper and lower insulators 41, 43 are rigid, electrical insulators formed of a conventional material. Insulators 41, 43 sandwich between them a resilient bulk elastomer seal 45. Elastomer seal 45 is a cylindrical disc with an outer cylindrical surface in sealing engagement with lower housing cylindrical wall 37. Elastomer seal 45 is conventional and formed of a resilient rubber material such as EPDM (ethylene propylene diene monomer).

Three conductor passages 47 (only one shown) extend parallel to axis 38 through upper insulator 41, lower insulator 43 and elastomer seal 45. Each conductor passage 47 receives one of the insulated electrical conductors 48 of power cable 19 (FIG. 1). FIG. 2 shows only a portion of one of the conductors 48. When deformed by being squeezed between insulators 41, 43, elastomer seal 45 seals around each of the insulated conductors and also against lower housing cylindrical wall 37. Electrical terminals 49 (only one shown) are crimped to each of the electrical conductors of power cable 19 and mounted in each conductor passage 47 so as to protrude from the lower end or face 50 of lower insulator 43. An optional seal ring 51 may seal between the cylindrical exterior of lower insulator 43 and lower housing cylindrical wall 37.

Lower housing 26 has a lower end 53 with a reduced outer diameter. In this example, an elastomeric boot 55 fits over the reduced diameter portion of lower end 53 for sealing engagement with motor receptacle 23 (FIG. 1). Lower housing stop member 39 is spaced above lower end 53 a selected distance. In this example, lower housing stop member 39 is at the upper end of the reduced outer diameter portion of lower housing lower end 53.

Figure 3:
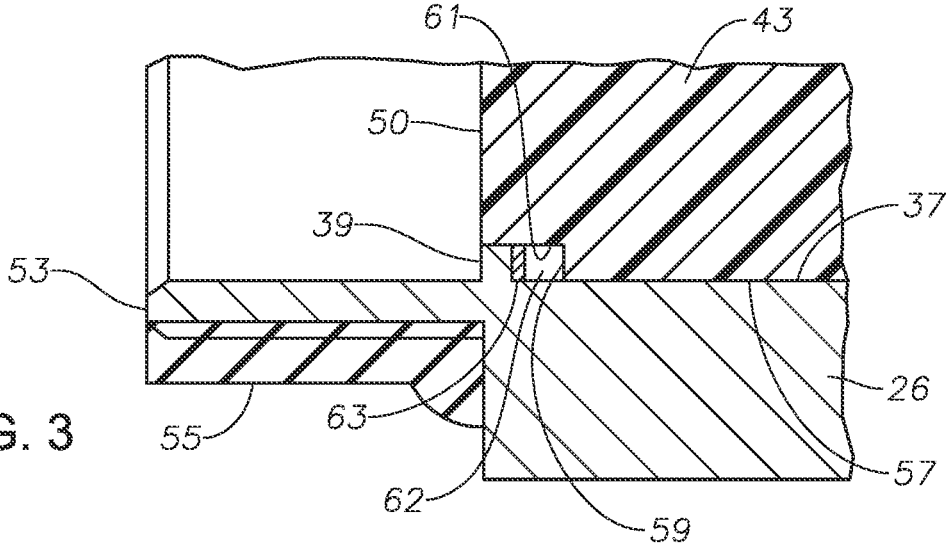
FIG. 3 is an enlarged view of a portion of the power connector of FIG. 2.

Referring to FIG. 3, lower insulator 43 has an annular downward facing shoulder 59 extending radially inward from a cylindrical exterior 57. Shoulder 59 defines a cylindrical nose 61 of lower insulator 43 that extends downward to a lower end or face 50 of lower insulator 43. The outer diameter of nose 61 fits closely within the inner diameter of stop member 39. Face 50 may be substantially flush with the lower side of stop member 39, as shown. Or, it may protrude slightly lower than stop member 39.

Figure 4:
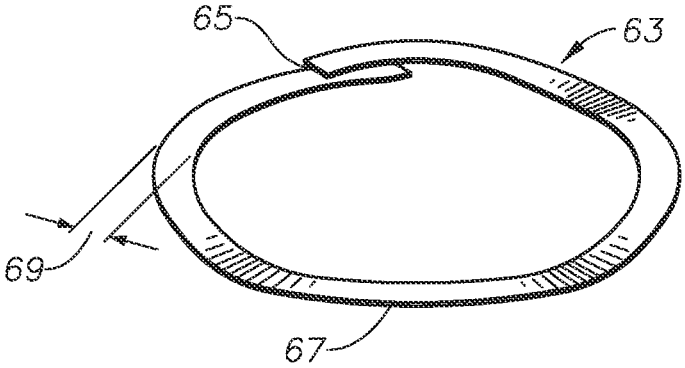
FIG. 4 is a perspective view of the insulator spring of the power connector of FIG. 3, shown removed from the connector.

Shoulder 59, stop member 39 and the exterior of nose 61 define an annular cavity 62 that is rectangular when viewed in the section of FIG. 3. An annular spring 63 fits within cavity 62. Referring to FIG. 4, in this embodiment, spring 63 is a metal wave spring having two ends 65 that overlap each other. Spring 63 is formed of a flat strip that may be metal with undulations 67 around it. Spring 63 has a radial width 69 between its inner and outer diameters that is slightly less than the radial width of cavity 62. As illustrated in FIG. 3, undulations 67 cause one side of spring 63 to abut stop member 39 and an opposite side (not shown) to abut shoulder 59. Pushing lower insulator 43 downward in lower housing 26 moves shoulder 59 toward stop member 39 and resiliently compresses spring 63. The axial thickness of spring 63 from one undulation to another decreases when spring 63 is compressed.

During assembly, a technician slides spring 63, insulators 41, 43 and elastomer seal 45 into lower housing 26, placing spring 63 in abutment with stop member 39. The insulated electrical conductors 48 are stripped, inserted into passages 47, and connected to terminals 49. Initially the upper end of upper insulator 41 will protrude a short distance above lower housing upper end 31 because spring 63 will not yet be compressed. That is, an axial length of the insulators 41, 43, elastomer seal 45 and spring 63 while stacked together in a free state without compression is greater than an axial distance from the stop member 39 to the upper end 31 of lower housing 26.

The technician abuts upper housing lower end 29 with upper insulator 41 and tightens the bolts that secure upper housing 25 to lower housing 26. This step causes upper housing lower end 29 to push upper insulator 41 downward in lower housing 26. Upper insulator 41 pushes elastomer seal 45 and lower insulator 43 downward, with the outer cylindrical walls of insulators 41, 43 and elastomer seal 45 sliding on lower housing cylindrical wall 37. Securing upper housing 25 to lower housing 26 axially compresses spring 63 and deforms elastomer seal 45, causing it to seal around the insulated conductors 48 and against lower housing cylindrical wall 37. The lower end of lower insulator face 50 may protrude a short distance downward past stop member 39 once upper housing 25 is secured to lower housing 26.

Epoxy may be filled into upper housing 25, immersing the insulated conductors, then cured. If elastomer seal 45 is not cured before it is inserted into lower housing 26, the technician will apply heat afterward, such as by placing the assembly in an oven, to cause it to cure.

The compression of spring 63 will provide a bias or constant compressive force on elastomer seal 45. The constant axially directed compressive force retards elastomer seal 45 from losing its sealing function.

The present invention described herein, therefore, is well adapted to carry out the objects and attain the ends and advantages mentioned, as well as others inherent therein. While only one embodiment of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. An electrical power connector for an electrical submersible well pump motor, comprising:

a housing having a bore with a longitudinal axis and an inward-facing side wall, the bore having an upper opening for receiving insulated conductors of a power cable;

a pair of rigid insulators within the bore of the housing, each of the insulators having a cylindrical outward-facing side in contact with the inward-facing side wall wherein the insulators comprise a lower insulator and an upper insulator, wherein a lower end of the lower insulator has a reduced diameter to form a nose that is spaced radially inward from the housing to form a shoulder on the outer surface of the lower insulator adjacent the nose, wherein an annular stop member is in the housing so that a cavity is formed between the stop member, nose, shoulder, and inner surface of housing;

a resilient elastomer seal sandwiched between the insulators and in sealing engagement with the inward-facing side wall;

a plurality of passages extending through each of the insulators and the elastomer seal for receiving the insulated conductors; and a wave spring in abutment with one of the insulators that exerts an axial compressive force on the elastomer seal, the wave spring having ends that overlap one another.

2. The connector according to claim 1, wherein the passages are smooth.

3. The connector according to claim 1, wherein the wave spring is in a bottom of the housing and circumscribes electrical terminals that are crimped to the conductors and are mounted in each passage so as to protrude from a lower end of a lower one of the insulators.

4. The connector according to claim 1, further comprising:

a stop member protruding inward from the inward-facing side wall;

an annular shoulder formed on a lower one of the insulators and facing the stop member;

and wherein the spring is compressed between the annular shoulder and the stop member.

5. The connector according to claim 1, wherein the wave spring is disposed in the cavity.

6. The connector according to claim 1, wherein:

the spring exerts a reactive force along a load path through the elastomer seal and into the housing.

7. An electrical power connector for an electrical submersible well pump motor, comprising:

an upper housing having an upper end with an upper opening for receiving a power cable;

a lower housing having an upper end that abuts and secures to a lower end of the upper housing, the lower housing having a longitudinal axis, an upper opening at its upper end;

a rigid upper insulator extending across the upper opening of the lower housing;

a rigid lower insulator located in the lower housing below the upper insulator;

a resilient elastomer seal sandwiched between the upper and lower insulators;

oppositely facing shoulders in the housing that respectively are in compressive engagement with outer radial portions of the upper and lower insulators;

a plurality of passages extending through the upper and lower insulators and the elastomer seal for receiving insulated electrical conductors of the power cable; and a wave spring in abutment with one of the insulators that exerts an axial compressive force on the elastomer seal.

8. The connector according to claim 7, further comprising:

wherein the shoulders comprise a downward facing shoulder and an inward-protruding stop member, wherein the downward facing annular shoulder is on and above a lower end of the lower insulator;

wherein the inward-protruding stop member is in the lower housing and is spaced below the annular shoulder; and wherein the wave spring is located between the stop member and the annular shoulder.

9. The connector according to claim 8, wherein:

the upper insulator has an upper end that is abutted by the lower end of the upper housing, creating a downward force on the upper insulator that passes through the elastomer seal and the lower insulator, axially compressing the spring.

10. The connector according to claim 9, wherein:

the stop member comprises a circular lip formed in the lower housing.

11. The connector according to claim 9, wherein:

an axial length of the insulators, elastomer seal and spring stacked together and while in a free state is greater than an axial distance from the stop member to the upper opening in the lower housing.

12. The connector according to claim 7, wherein the wave spring has opposing ends that are overlapping.

13. The connector according to claim 7, wherein the spring comprises an annular, flat band having undulations.

14. The connector according to claim 7, wherein the spring comprises an annular band having undulations and two ends that overlap each other.

15. The connector according to claim 7, wherein:

prior to connecting the upper housing to the lower housing, the upper insulator protrudes above the opening in the upper end of the lower housing; and while connecting the upper housing to the lower housing, the upper housing abuts and pushes the upper insulator downward, deforming the elastomer seal and compressing the spring.

16. An electrical power connector for an electrical submersible well pump motor, comprising:

an upper housing having an upper end with an upper opening for receiving a lower end of a power cable;

a lower housing having an upper end that abuts and secures to a lower end of the upper housing, the lower housing having a bore with a longitudinal axis and an inward-facing side wall, the lower housing having an upper opening at its upper end;

a rigid upper insulator extending across the upper opening of the lower housing;

a rigid lower insulator extending across the bore in the lower housing below the upper insulator;

a resilient elastomer seal sandwiched between the upper and lower insulators, the elastomer seal having an outer side in sealing engagement with the inward-facing side wall;

a downward facing annular shoulder on the lower insulator above a lower end of the lower insulator;

an annular stop member encircling the inward-facing side wall of the lower housing and spaced below the annular shoulder, defining an annular cavity between the annular stop member and the annular shoulder;

a plurality of passages extending through the upper and lower insulators and the elastomer seal for receiving insulated conductors of the power cable;

an axially compressible wave spring in the annular cavity; and wherein the upper housing exerts a downward force on the upper insulator, elastomer seal and lower seal, axially compressing the spring between the annular shoulder and the stop member and causing the spring to exert a reactive force with a load path through the lower insulator, the elastomer seal and spaced radially away from the passages, the upper insulator and into the upper housing.

17. The connector according to claim 16, wherein:

an axial length of the insulators, elastomer seal and spring stacked together and while in a free state is greater than an axial distance from the stop member to the upper opening in the lower housing.

18. The connector according to claim 16, wherein a compressive load extends between the lower insulator and the housing adjacent to an outer periphery of the lower insulator.

19. The connector according to claim 16, wherein the wave spring is disposed in a cavity formed adjacent a lower end of the lower insulator.

20. The connector according to claim 16, wherein the wave spring comprises two ends that overlap each other.

* * * * *